United States Patent [19]

Mott

[11] 4,150,592

[45] Apr. 24, 1979

[54] STRAP TOOL

[76] Inventor: Philip G. Mott, 2102 W. 48 Terr., Westwood Hills, Kans. 66205

[21] Appl. No.: 827,224

[22] Filed: Aug. 24, 1977

[51] Int. Cl.[2] ..... B25B 13/52

[52] U.S. Cl. ..... 81/64

[58] Field of Search ..... 81/64, 3.43

[56] References Cited

U.S. PATENT DOCUMENTS

| | | | |
|---|---|---|---|
| 747,679 | 12/1903 | Bliss | 81/64.1 |
| 1,521,342 | 12/1924 | Thomas et al. | 81/64 |

FOREIGN PATENT DOCUMENTS

| | | | |
|---|---|---|---|
| 1782406 | 8/1975 | Fed. Rep. of Germany | 81/64 |

*Primary Examiner*—James L. Jones, Jr.

*Attorney, Agent, or Firm*—Schmidt, Johnson, Hovey & Williams

[57] ABSTRACT

An improved wrench particularly adapted for use with cylindrical, delicate workpieces such as chrome-plated or plastic pipes, is provided with a resilient, spiralled strip adapted to be simply wrapped around the circumference of the workpiece for gripping and turning the latter when an elongated handle attached to one end of the strip is manipulated by the user. The strip is provided with a straight stretch adjacent the handle, which is held in substantial parallelism with the longitudinal axis of the handle, and is effective in translating an increased amount of the force applied to the handle into a usable tension force on the strip in a direction tangent to the circumference of the workpiece, rather than into an inwardly directed force that is either wasted or may damage the workpiece. The handle includes an arcuate concave surface end portion which is adapted to complementally engage a section of the spiralled strip overlying a substantial area of the surface of the workpiece, thereby distributing any inward force at the end of the handle over a relatively large area of the workpiece and avoiding the application of a concentrated inner force against the workpiece. The strip may be retractably stored in a compartment formed within the handle, and the user may withdraw a selected length of the strip from the handle to permit use of the wrence with workpieces having various circumferential dimensions.

5 Claims, 8 Drawing Figures

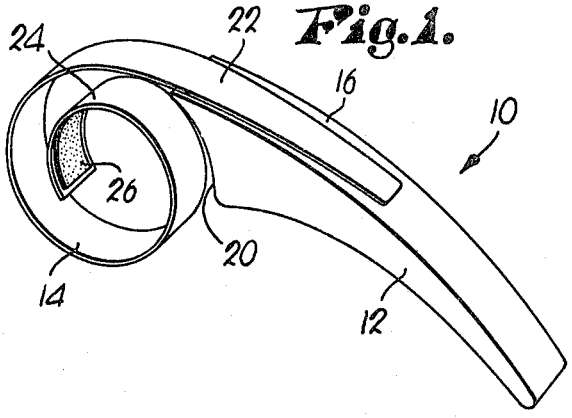
Fig.1.
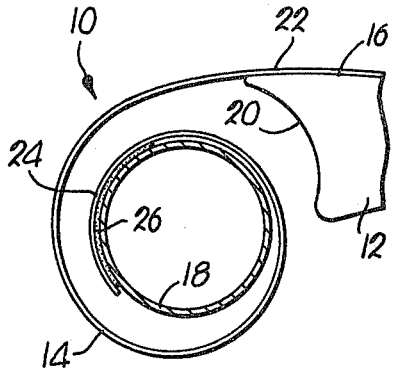
Fig.2
Fig.3.
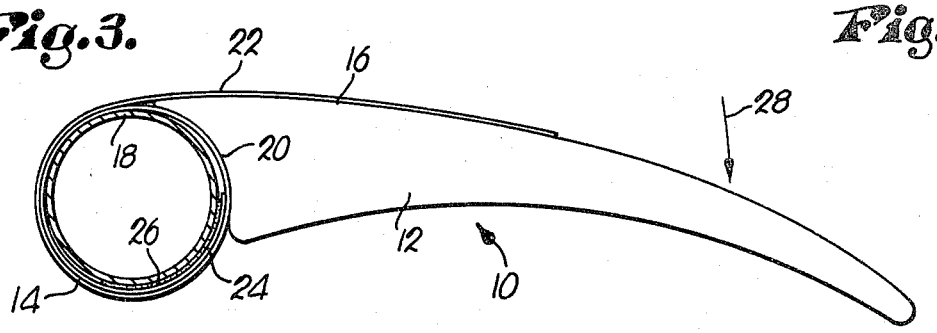
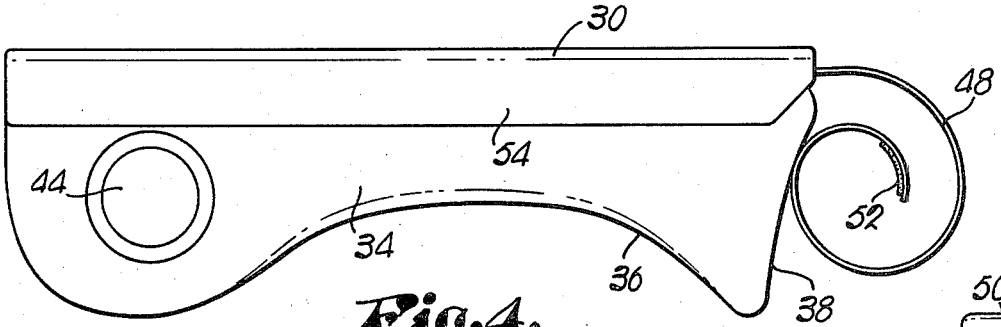
Fig.4.
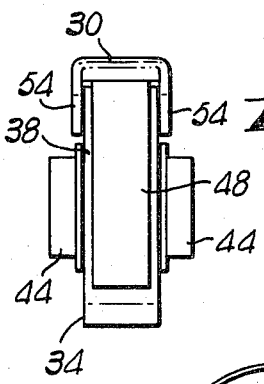
Fig.5.
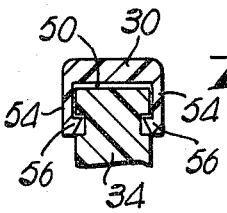
Fig.8.
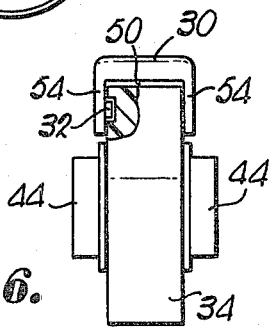
Fig.6.
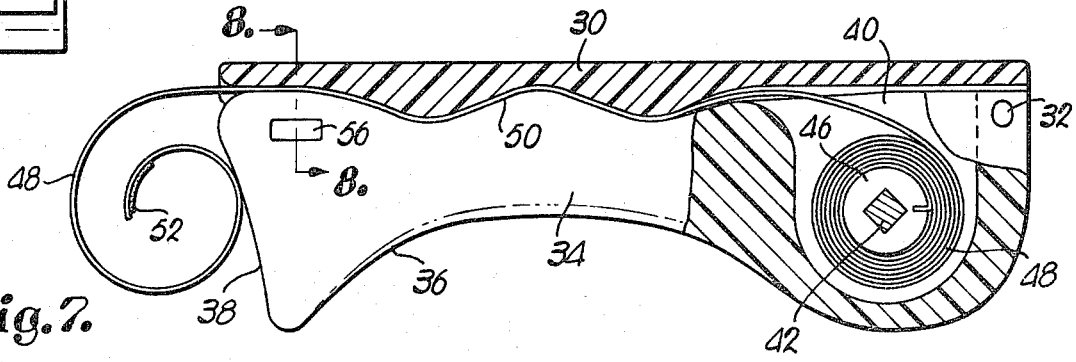
Fig.7.

STRAP TOOL

BACKGROUND AND BRIEF DESCRIPTION OF THE INVENTION

This invention generally relates to wrench tools and pertains more particularly to wrenches of the type which employ a flexible strap-like element to grip the object which is to be manipulated.

Pipe wrenches and jar openers having a flexible, strap-like element adapted to be wrapped around the object to be gripped are generally known in the art. A torque applying lever element is typically connected to the strap in some manner and contacts the surface of the object at a relatively restricted zone, which serves as a fulcrum about which a force applied by the user is transmitted partially to the strap in order to twist or turn the object in a wrenching manner, but partially as an inwardly directed and substantial force of engagement of the lever with such fulcrum zone of the workpiece.

Known prior art broadly related to the same field as the present invention is disclosed in U.S. Pat. Nos. 785,711; 1,051,562; 1,667,620; and 2,422,715. Such prior art patents disclose tools which are either unnecessarily complex or less than completely effective in terms of the efficiency with which the force that is manually applied by the user is effectively translated to a torque for wrenching the object being gripped. Moreover, the more analagous prior art wrenches may not be used in conjunction with rather delicate workpieces such as thin-walled chrome-plated pipes and plastic pipes, since the prior art designs place concentrated, inwardly directed stresses on the workpiece which can damage the surface, or even crush wall portions, of the workpiece. Thus, a need exists for a practical and effective wrench device which may be conveniently and safely used with the rather delicate variety of pipes now in widespread use, and which avoids structural damage to such pipes while at the same time providing the comparatively high magnitudes of torque necessary for manipulation of such pipes in their usual applications such as plumbing fixturing.

The present invention overcomes the deficiencies inherent in prior art wrench designs, by providing a tool which is simple in construction and easily used, yet which is particularly effective in translating the manually applied force to a torque on the workpiece, while also distributing the stresses over the surface area of the workpiece in a manner to avoid damage to the more delicate types of workpieces. According to one embodiment of the present invention, an elongate, resilient, spiralled strip has the outer end thereof connected to an elongate force applying handle. The free inner end of the strip has a friction pad secured thereto for initially gripping the surface of the workpiece when the user slips the strip around the workpiece and twists the handle in a wrenching manner. The handle includes an arcuate, concave surface portion adjacent the outer end of the strip, which is adapted to complementally engage a substantial surface portion of a generally cylindrical workpiece. The arcuate portion of the handle functions to apply a turning force to the outer end of the strip upon turning of the handle in a manner to translate most of the turning force to a tension force on the strip, rather than into an inwardly directed force upon the workpiece, while also functioning to distribute the inwardly directed components of the applied turning force over a wider area of the workpiece surface in order to avoid stress concentrations on the workpiece, and possible resultant damage thereto. An alternate embodiment of the invention further provides a housing compartment integral within the handle for storing a length of the strip, a selected portion of which may be removed from the handle in order to accommodate workpieces having different circumferences.

A primary object of the invention is to provide a strap tool for gripping and turning delicate, generally cylindrically-shaped workpieces, which is effective in applying a relatively large magnitude of torque to the workpiece, but yet which avoids marring, denting, crushing or otherwise damaging the workpiece.

Another object of the invention is to provide a wrench which includes a strap element adapted to be wrapped around the workpiece for gripping and turning the latter, wherein an increased amount of the force applied to the wrench by the user is translated into a turning, tension force on the strap in a direction tangent to the surface of the workpiece, rather than into a potentially damaging and wasted force directed inwardly toward the longitudinal axis of the workpiece.

A further object of the invention is to provide a wrench of the mentioned type which obviates the need for tensioning adjustment means or mechanism for retaining the strap element in securement around the workpiece. As a corollary to the foregoing object it is a still further object to provide a wrench having a gripping strap element which is particularly simple in construction and which may be quickly and easily secured in operative relationship to the workpiece.

Another object of the invention is to provide a wrench having a gripping strap element which may be selectively adjusted in length to accommodate workpieces of various sizes.

Other and further objects of the invention will be made clear or become apparent in the course of the following description of a preferred and alternate embodiment of the invention.

DETAILED DESCRIPTION OF THE INVENTION

In the accompanying drawings:

FIG. 1 is a perspective view of a strap tool which forms the preferred embodiment of the invention;

FIG. 2 is a fragmentary, side elevational view of the preferred embodiment of FIG. 1, shown in operative relationship to a cross-sectioned cylindrical workpiece, prior to tightening the strap tool around the workpiece;

FIG. 3 is a side elevational view of the preferred embodiment, similar to FIG. 2, but showing the strap tool in tightened, gripping relationship around the workpiece;

FIG. 4 is a side elevational view of an alternate embodiment of the invention;

FIG. 5 is an elevational view of one end of the alternate embodiment shown in FIG. 4;

FIG. 6 is an elevational view of the other end of the alternate embodiment, portions being broken away in cross section to reveal a hinge means for swingably interconnecting the lever portion of the handle with the body portion thereof;

FIG. 7 is a longitudinal side view of the alternate embodiment, parts being broken away in cross section to show a portion of the strap element housed within the handle; and FIG. 8 is a cross-sectional view taken along line 8—8 of FIG. 7.

Turning first to FIGS. 1, 2 and 3, a strap tool broadly designated by the numeral 10 comprises an elongate handle 12 and a spirally configured strap element 14. Handle 12 may be manufactured from any suitable rigid material and includes a generally straight stretch 16 which extends longitudinally in a direction substantially tangential to the circumferential surface of the generally cylindrical workpiece 18. Handle 12 further includes an arcuate, generally concave surface portion 20 adjacent the workpiece 18, the curvature of which surface portion 20 closely corresponds to the circumferential curvature of the workpiece 18, such that the surface portion 20 complementally engages the workpiece 18 when the tool 10 is tightened around the workpiece 18 as shown in FIG. 3.

Strap element 14 comprises an elongate strip of relatively thin, flexible, resilient material, and has sufficient length to be wrapped around the workpiece 18 at least one time. In the preferred form, strap element 14 is manufactured from a metallic material and is permanently formed into an overlapping spiralled geometry in a rest position, but is bendable out of the spiral form, and therefore may be uncoiled by the user, in order to allow the strap element 14 to be installed around the workpiece 18. The outer end of strap element 14 terminates in a generally straight portion 22 which is fastened in overlapping relationship to the straight stretch 16 of handle 12 in any suitable manner, it being observed that the straight portion 22 is maintained generally parallel with the straight stretch 16 of handle 12. The free inner end 24 of the strap element 14 possesses slightly more curvature than the curvature of the workpiece 18 in order that the inner end 24 may actually engage, and preferably slightly grip, the workpiece 18. A friction pad 26 is suitably secured to the interior facing side of the inner end 24.

In operation, the user first uncoils the strap element 14 somewhat to permit the workpiece 18 to be positioned within the curvature of the inner end 24 of the strap element 14, whereupon the latter is released to wrap itself around the workpiece 18 when the strap element 14 springs back to its normal loosely coiled configuration. With the strap element 14 loosely coiled around the workpiece 18, the friction pad 26 is in friction engagement with the surface of the workpiece 18. The user may then manually apply a turning force to the handle 12 in a direction corresponding to the arrow 28, causing the handle to turn in a clockwise direction as viewed in FIG. 3. As the handle 12 is turned, the friction pad 26 continues to grip the workpiece 18 and maintain the inner end 24 essentially stationary with respect to the workpiece 18, while the intermediate and outer stretches of the strap element 14 turn clockwise along with the handle 12. This turning action results in a progressive reduction of the diameter of the coils comprising the strap element 14, until such coils are in overlapping contact with each other and tightly wrapped around the workpiece 18 as shown in FIG. 3. At this point, the "slack" in the strap element 14 has been taken up, and the arcuate surface portion 20 is in overlaying, force transmitting, but slidable engagement with a portion of the coils of strap element 14.

With the strap element 14 now tightly gripping the workpiece 18, additional force applied to the handle 12 in the direction of the arrow 28 is transmitted through the handle 12 to the straight portion 22 of the strap element 14, placing the portion 22 in tension. As may best be seen in FIG. 3, the portion 22 and stretch 16 are essentially tangential to the surface of the workpiece 18, and are therefore perpendicular to the radius of the circular cross-section of the workpiece 18 at the point of tangency; thus, it is apparent that essentially all of the tension force applied to the portion 22 of the strap element 14 is translated into a torque upon the workpiece 18 which is effective in twisting, turning or otherwise manipulating the workpiece 18.

By the very nature of the geometry of the strap tool 10, the handle 12 functions to some extent as a classical lever arm in that a force applied at the outer extremity of handle 12 in the direction of arrow 28 imparts a force on the other end of the handle 12 in the opposite direction of arrow 28 by virtue of the fact that a portion of the handle 12 is in contact with the workpiece 18 and establishes a fulcrum point at such point of contact, around which fulcrum point the force applied at 28 is transmitted to the workpiece 18.

It is a significant feature of the present invention that the above-mentioned fulcrum is distributed over a rather broad area of the surface of the workpiece 18, rather than upon a small linear zone thereon, by virtue of the fact that the handle 12 does not contact the workpiece 18 at any single point but rather, the broad area of contact defined by the arcuate surface portion 20 establishes a distributed fulcrum area. Consequently, the stresses imposed upon the workpiece 18 at the fulcrum area are spread out rather than being concentrated in a small area, and as a result, a greater amount of turning force may be applied to the handle 12 without crushing or damaging the workpiece 18 where the latter comprises a rather delicate construction such as plastic or thin-walled chromium pipe. Moreover, the arcuate surface portion 20 further functions to translate the inwardly directed fulcrum force components into an arcuate force component which follows the arc defined by the surface of the workpiece 18 as the handle 12 is turned, thus, in effect, reducing the friction between the surface portion 20 and the strap element 14 and thereby decreasing the magnitude of force which the user must apply to the handle 12 to produce a given magnitude of torque upon the workpiece 18.

It is apparent at this point that the straight stretch 16 and arcuate portion 20 of the handle 12 define a unique structural combination which functionally cooperate to increase the magnitude of torque which may be effectively applied to the workpiece 18 while also precluding damage to the surface of the workpiece 18 otherwise experienced with the use of prior art type strap-wrenches.

Referring now to FIGS. 4 through 8, an alternate embodiment of the present invention includes an essentially two-piece handle construction comprising a gripping lever 30 which is swingably mounted by hinge means 32 to one end of the main body portion 34. Body portion 34 and lever 32 may be constructed from any suitable material which provides the needed structural rigidity. Body portion 34 includes a crescent-shaped cutout area 36 adapted to accommodate the grasp of the user's hand, and further includes an arcuate, concave-shaped surface area 38 having a curvature selected to generally conform to the circumferential surface of the class of workpieces with which the strap tool is designed to be used.

Body portion 34 has provided in one end thereof, adjacent hinge means 32, a housing compartment 40 which presents an access opening to the lever 30 when the latter is swung away from the body portion 34. A rotatable shaft 42 is journaled in, and passes through, the lateral sidewalls of the body portion 34 and has secured on the opposite ends thereof, adjustment knobs 44. A spool 46 is secured on the shaft 42 within compartment 40, and has wrapped therearound a length of a flexible strap element 48 such as a fiber reinforced plastic strip or the like. One end of the strap element 48 is secured to the spool 46 while the other end thereof is trained through a sinuous, serpentine-like passageway 50 which lies between the lever 30 and body portion 34, which passageway 50 is defined by opposing, undulating surface portions of lever 30 and body portion 34. A friction pad 52 is suitably secured to one side of the outer end of strap element 48 which is trained through passageway 50. Lever 30 includes a pair of longitudinally extending, parallel flange portions 54 which are adapted to overlap the exterior sidewalls of the body portion 34 and function to both laterally restrain the strap element 48 within the passageway 50, and also prevent lateral shifting of the lever 30 with respect to body portion 34 when the handle is manipulated during use. A pair of inwardly directed lock tabs 56 depend from the flange portions 54 and seat within corresponding depressions in the sidewalls of body portion 34 in order to retain the lever 30 in its closed position with respect to body portion 34. Lever 30 and flange portions 54 may be made of a bendable plastic-like material to allow flange portions 54 to be laterally spread somewhat by the user whereby tabs 56 may be removed from vertical registration with their corresponding depressions, thus allowing the user to swing lever 30 away from body portion 34 about hinge means 32. The depressions within which tabs 56 seat are marginally larger than the tabs 56 in order to provide lost motion when the lever 30 is retained in its locked, closed position with respect to body portion 34.

In operation, the compartment 40 provides an internal storage area within which to store the entire length of strap element 48, or at least that portion of the latter which is not required for use. In order to remove the desired length of the strap element 48, the user first releases lock tabs 56 and swings the lever 30 away from body portion 34, thereby exposing the compartment 40 and strap element 48, whereupon the user may seize the exposed outer end of strap element 48 and pull a desired length of the same out of the compartment 40 and along the sinuous passageway 50 until such end extends beyond the outer extremity of the body portion 34. The lever 30 may then be closed and locked against body portion 34. At this point, there is sufficient clearance between the strap element 48 and the undulating surface portions of the lever 30 and body portion 34 to permit longitudinal movement of the strap element 48 within the passageway 50. Thus, with the end of strap element 48 exposed from the extremity of the handle, the user may then proceed to further draw out whatever additional length of the strap element 48 may be required to wrap around a particular workpiece. After wrapping the strap element 48 around the workpiece, the user may then single-handedly grip both the lever 30 and main body portion 34, thus tending to compress or force these two components of the handle 12 toward each other and against the opposite faces of the strap element 48 by virtue of the previously mentioned lost motion feature. The compressive force of the user's grip in combination with the sinuous geometry of the passageway 50 tightly grips the strap element within the handle and prevents any further additional length of strap element 48 from being unwound from the spool 46, thus fixing the length of the strap element 48 which is temporarily secured to the handle 12 while the user applies a twisting force on the workpiece. By this feature of the invention, the need for a separate means for locking the spool 46 to prevent rotation thereof when a twisting force is applied to the handle 12, is eliminated.

From the foregoing, it is apparent that the invention provides an especially simple means for gripping and turning rather delicate cylindrical workpieces, without damage thereto, while also providing a strap tool which is particularly efficient in terms of translating the amount of force which is applied to the tool into an effective torque for rotating the workpiece. Thus, it will be observed that my improved strap tool not only provides for the reliable accomplishment of the objects of the invention, but does so in a particularly simple and economical manner. It is recognized, of course, that those skilled in the art may make various modifications or additions to the embodiments chosen to illustrate the invention without departing from the gist and essence of my contribution to the art. Accordingly, it is to be understood that the protection sought and to be afforded hereby should be deemed to extend to the subject matter claimed and all equivalents thereof fairly within the scope of the invention.

I claim:

1. A wrench for gripping and exerting a turning force upon a generally cylindrical object including:

an elongate handle adapted for disposition during use with one end thereof adjacent said object and the remainder thereof extending outwardly from said object in a direction generally radial to the latter, said handle including a main body portion and a gripping lever portion mounted on said body portion and shiftable toward the latter;

an elongate relatively flexible strip of sufficient length adapting a distal portion thereof to be wrapped around the circumference of said object and into overlapped relationship upon itself; and means for securing a second portion of said strip to said handle in manner for disposing a stretch of said strip intermediate said portions thereof in a disposition extending from said handle to the proximate extremity of said distal portion in a direction substantially parallel with said radial direction and substantially tangential to the circumference of said object, said second portion of said strip including an extension thereof extending from said stretch thereof between said body and lever portions of said handle, said extension of said strip being secured to said handle when said lever portion is shifted toward said body portion, whereby, upon applying a force to said handle in a direction generally perpendicular to said radial direction, a tension force for tightening said distal portion of said strip upon said object and for turning said object will be transmitted to said proximate extremity of said distal portion through said stretch along a straight path substantially tangent to the circumference of said object.

2. The invention of claim 1, wherein:

said body portion and said lever portion of said handle are provided with opposed surfaces for oppositely gripping said extension of said strip, said surfaces being substantially complemental and defining a sinuous zone in which said extension of said strip may be gripped.

3. The invention of claim 1, wherein:

said extension of said strip includes a terminal portion of greater length than said zone, and said main body portion of said handle is provided with means for storing a selectable part of said terminal portion of said strip internally thereof, whereby the length of said distal portion of said strip may be selectively adjusted to objects of differing circumference.

4. The invention of claim 1, wherein:

said lever portion is provided with marginal flanges extending into overlapping relationship with said main body portion to provide lateral confinement for said extension of said strip therebetween.

5. The invention of claim 1, wherein there are provided:

hinge means swingably interconnecting said lever portion of said handle with said main body portion thereof; and cooperating, interlocking, lost motion means on said main body portion and said lever portion for permitting said movement of said lever portion relative to said body portion.

* * * * *